US008816852B2

(12) United States Patent
Dunson

(10) Patent No.: US 8,816,852 B2
(45) Date of Patent: Aug. 26, 2014

(54) TAMPER-PROOF ALARM COMPONENT AND METHODS OF MAKING AND USING THE SAME

(76) Inventor: Dan L. Dunson, Griffin, GA (US)

( * ) Notice: Subject to any disclaimer, the term of this patent is extended or adjusted under 35 U.S.C. 154(b) by 220 days.

(21) Appl. No.: 13/427,098

(22) Filed: Mar. 22, 2012

(65) Prior Publication Data

US 2012/0256746 A1 Oct. 11, 2012

Related U.S. Application Data

(60) Provisional application No. 61/472,507, filed on Apr. 6, 2011.

(51) Int. Cl.
*G08B 13/14* (2006.01)
*G08B 13/20* (2006.01)

(52) U.S. Cl.
CPC ..... *G08B 13/20* (2013.01)
USPC ..... 340/568.1; 340/665; 361/812

(58) Field of Classification Search
CPC ..... G01D 11/245; G08B 13/1409; H01L 2224/45147
USPC ..... 340/541, 568.1, 665; 361/600, 679, 361/807, 812
See application file for complete search history.

(56) References Cited

U.S. PATENT DOCUMENTS

| | | | | |
|---|---|---|---|---|
| 4,250,434 | A * | 2/1981 | Valansot | 340/573.1 |
| 5,113,176 | A * | 5/1992 | Harris | 340/573.7 |
| 5,734,138 | A * | 3/1998 | Goto | 200/16 R |
| 7,570,170 | B2 * | 8/2009 | Wallner | 340/573.1 |

* cited by examiner

*Primary Examiner* — Thomas Mullen
(74) *Attorney, Agent, or Firm* — Withers & Keys, LLC

(57) ABSTRACT

Tamper-proof alarm components for detecting theft, for example, of copper, air conditioning component(s), and/or an air conditioning unit are disclosed. Methods of making and using tamper-proof alarm components are also disclosed.

22 Claims, 9 Drawing Sheets

TAMPER-PROOF ALARM COMPONENT AND METHODS OF MAKING AND USING THE SAME

CROSS-REFERENCE TO RELATED APPLICATIONS

This patent application claims the benefit of priority to U.S. Provisional Patent Application Ser. No. 61/472,507 filed on Apr. 6, 2011 and entitled "TAMPER-PROOF ALARM COMPONENT AND METHODS OF MAKING AND USING THE SAME", the subject matter of which is hereby incorporated by reference in its entirety.

FIELD OF THE INVENTION

The present invention relates generally to tamper-proof alarm components for detecting theft, for example, of copper, air conditioning component(s), and/or an air conditioning unit. The present invention further relates to methods of making and using tamper-proof alarm components to detect theft of, for example, copper, air conditioning component(s), and/or an air conditioning unit.

BACKGROUND OF THE INVENTION

Although many systems exist to try to prevent theft of copper, air conditioning component(s), and/or an air conditioning unit, there still exists a need in the art for tamper-proof devices that efficiently and effectively detect theft of copper, air conditioning component(s), and/or an air conditioning unit. For example, in some known systems, a would-be thief can short-circuit the closed loop of an alarm circuit connected to an air conditioning system so that the security system continues to detect a closed loop (i.e., electricity is still flowing within a continuous loop) even though the would-be thief subsequently cuts the alarm circuit of the air conditioning system and removes parts (e.g., copper) and/or the entire air conditioning unit.

There exists a need in the art for tamper-proof devices that efficiently and effectively detect theft of copper, air conditioning component(s), and/or an air conditioning unit even in situations where a would-be thief attempts to short-circuit the closed loop of an alarm circuit connected to an air conditioning system.

SUMMARY OF THE INVENTION

The present invention provides tamper-proof alarm components for detecting theft, for example, of copper, one or more air conditioning components, and/or an air conditioning unit even in situations where a would-be thief attempts to short-circuit the closed loop of an alarm circuit connected to an air conditioning system.

The present invention is directed to tamper-proof alarm components. In one exemplary embodiment of the present invention, the tamper-proof alarm component of the present invention comprises a tamper-proof alarm component for detecting theft, wherein the alarm component comprises a protective sleeve having a first sleeve end and a second sleeve end, the second sleeve end being positioned opposite the first sleeve end; a pressure switch positioned so as to extend through the protective sleeve, the pressure switch comprising (i) a switch trigger proximate the first sleeve end, (ii) one or more electrically conductive switch inlet wires, and (iii) one or more electrically conductive switch outlet wires, the switch trigger being movable between an open switch circuit position and a closed switch circuit position in response to a threshold amount of pressure being exerted on the switch trigger; and a hardened matrix material filling at least a portion of an inner sleeve volume positioned within the protective sleeve and extending a length along the protective sleeve from proximate the second sleeve end to the pressure switch, the hardened matrix material encapsulating (i) at least a portion of each of the one or more electrically conductive switch inlet wires positioned within the protective sleeve, and (ii) at least a portion of each of the one or more electrically conductive switch outlet wires positioned within the protective sleeve.

In another exemplary embodiment, the tamper-proof alarm component of the present invention comprises a protective sleeve having a first sleeve end and a second sleeve end, the second sleeve end being positioned opposite the first sleeve end; a pressure switch positioned so as to extend through the protective sleeve, the pressure switch comprising (i) a switch trigger proximate the first sleeve end, (ii) one or more electrically conductive switch inlet wires, and (iii) one or more electrically conductive switch outlet wires, the switch trigger being movable between an open switch circuit position and a closed switch circuit position in response to a threshold amount of pressure being exerted on the switch trigger; a sleeve resistor positioned along one or more of the one or more electrically conductive switch outlet wires, wherein when two or more sleeve resistors are present, the two or more sleeve resistors are in parallel relationship with one another; and a hardened matrix material filling at least a portion of an inner sleeve volume positioned within the protective sleeve and extending a length along the protective sleeve from proximate the second sleeve end to the pressure switch, the hardened matrix material encapsulating (i) at least a portion of each of the one or more electrically conductive switch inlet wires positioned within the protective sleeve, (ii) at least a portion of each of the one or more electrically conductive switch outlet wires positioned within the protective sleeve, and (iii) any sleeve resistor positioned along the one or more electrically conductive switch outlet wires and within the protective sleeve.

In yet another exemplary embodiment, the tamper-proof alarm component of the present invention comprises a protective sleeve having a first sleeve end and a second sleeve end, the second sleeve end being positioned opposite the first sleeve end; a pressure switch positioned so as to extend through the protective sleeve, the pressure switch comprising (i) a switch trigger proximate the first sleeve end, (ii) a single electrically conductive switch inlet wire, and (iii) one or more electrically conductive switch outlet wires, the switch trigger being movable between an open switch circuit position and a closed switch circuit position in response to a threshold amount of pressure being exerted on the switch trigger; a sleeve resistor positioned along one or more of the one or more electrically conductive switch outlet wires, wherein when two or more sleeve resistors are present, the two or more sleeve resistors are in parallel relationship with one another; and a hardened matrix material filling at least a portion of an inner sleeve volume positioned within the protective sleeve and extending a length along the protective sleeve from proximate the second sleeve end to the pressure switch, the hardened matrix material encapsulating (i) a portion of the single electrically conductive switch inlet wire positioned within the protective sleeve, (ii) a portion of each of the one or more electrically conductive switch outlet wires positioned within the protective sleeve, and (iii) all of the sleeve resistors.

The present invention is also directed to methods of making tamper-proof alarm components. In one exemplary embodiment of the present invention, the method of making a tamper-proof alarm component comprises the steps of (I) positioning a pressure switch within a protective sleeve having a first sleeve end and a second sleeve end, the second sleeve end being positioned opposite the first sleeve end, the pressure switch comprising (i) a switch trigger proximate the first sleeve end, (ii) one or more electrically conductive switch inlet wires, and (iii) one or more electrically conductive switch outlet wires, the switch trigger being movable between an open switch circuit position and a closed switch circuit position in response to a threshold amount of pressure being exerted on the switch trigger, said positioning step comprising positioning the pressure switch so that the switch trigger is proximate the first sleeve end and the one or more electrically conductive switch inlet wires and the one or more electrically conductive switch outlet wires extend from the pressure switch and out of the second sleeve end; (II) filling at least a portion of the protective sleeve with a hardenable matrix material; and (III) allowing the hardenable matrix material to harden.

In another exemplary embodiment of the present invention, the method of making a tamper-proof alarm component comprises the steps of (I) positioning a pressure switch within a protective sleeve having a first sleeve end and a second sleeve end, the second sleeve end being positioned opposite the first sleeve end, the pressure switch comprising (i) a switch trigger proximate the first sleeve end, (ii) one or more electrically conductive switch inlet wires, and (iii) one or more electrically conductive switch outlet wires, the switch trigger being movable between an open switch circuit position and a closed switch circuit position in response to a threshold amount of pressure being exerted on the switch trigger, and a sleeve resistor positioned along one or more of the one or more electrically conductive switch outlet wires, wherein when two or more sleeve resistors are present, the two or more sleeve resistors are in parallel relationship with one another, said positioning step comprising positioning the pressure switch so that the switch trigger is proximate the first sleeve end and the one or more electrically conductive switch inlet wires and the one or more electrically conductive switch outlet wires extend from the pressure switch and out of the second sleeve end; (II) filling at least a portion of the protective sleeve with a hardenable matrix material; and (III) allowing the hardenable matrix material to harden.

The present invention is further directed to methods of using a tamper-proof alarm component. In one exemplary embodiment of the present invention, the method of using a tamper-proof alarm component comprises a method of detecting theft of (i) a copper coil within an air conditioning unit, (ii) any other component or components within the air conditioning unit, or (iii) the air conditioning unit, wherein the method comprises electrically connecting any of the herein-described alarm components of the present invention to the air conditioning unit.

The present invention is even further directed to kits comprising any of the herein-described alarm components of the present invention. In one exemplary embodiment, the kit comprises one or more herein-described alarm components of the present invention in combination with one or more additional kit components, wherein the one or more additional kit components comprise one or more tees, one or more 90 degree charging heads, one or more rubber O-rings for use with the one or more tees and/or 90 degree charging heads, one or more external resistors, one or more additional protective sleeves, one or more containers of hardenable matrix material, one or more pieces of electrically conductive wire, one or more technician tools, or any combination thereof.

The present invention is even further directed to air conditioning systems comprising any of the herein-described alarm components of the present invention. In one exemplary embodiment, the air conditioning system comprises a tamper-proof alarm component for detecting theft of one or more components of the air conditioning system, the alarm component comprising a protective sleeve having a first sleeve end and a second sleeve end, the second sleeve end being positioned opposite the first sleeve end; a pressure switch positioned so as to extend through the protective sleeve, the pressure switch comprising (i) a switch trigger proximate the first sleeve end, (ii) one or more electrically conductive switch inlet wires, and (iii) one or more electrically conductive switch outlet wires, the switch trigger being movable between an open switch circuit position and a closed switch circuit position in response to a threshold amount of pressure being exerted on the switch trigger; and a hardened matrix material filling at least a portion of an inner sleeve volume positioned within the protective sleeve and extending a length along the protective sleeve from proximate the second sleeve end to the pressure switch, the hardened matrix material encapsulating (i) at least a portion of each of the one or more electrically conductive switch inlet wires positioned within the protective sleeve, and (ii) at least a portion of each of the one or more electrically conductive switch outlet wires positioned within the protective sleeve.

In another exemplary embodiment, the air conditioning system comprises a tamper-proof alarm component for detecting theft on one or more components of the air conditioning system, the alarm component comprising a protective sleeve having a first sleeve end and a second sleeve end, the second sleeve end being positioned opposite the first sleeve end; a pressure switch positioned so as to extend through the protective sleeve, the pressure switch comprising (i) a switch trigger proximate the first sleeve end, (ii) one or more electrically conductive switch inlet wires, and (iii) one or more electrically conductive switch outlet wires, the switch trigger being movable between an open switch circuit position and a closed switch circuit position in response to a threshold amount of pressure being exerted on the switch trigger; a sleeve resistor positioned along one or more of the one or more electrically conductive switch outlet wires, wherein when two or more sleeve resistors are present, the two or more sleeve resistors are in parallel relationship with one another; and a hardened matrix material filling at least a portion of an inner sleeve volume positioned within the protective sleeve and extending a length along the protective sleeve from proximate the second sleeve end to the pressure switch, the hardened matrix material encapsulating (i) at least a portion of each of the one or more electrically conductive switch inlet wires positioned within the protective sleeve, (ii) at least a portion of each of the one or more electrically conductive switch outlet wires positioned within the protective sleeve, and (iii) any sleeve resistor positioned along the one or more electrically conductive switch outlet wires and within the protective sleeve.

These and other features and advantages of the present invention will become apparent after a review of the following detailed description of the disclosed embodiments and the appended claims.

BRIEF DESCRIPTION OF THE FIGURES

The present invention is further described with reference to the appended figures, wherein.

DETAILED DESCRIPTION OF THE INVENTION

The present invention is directed to tamper-proof alarm components for detecting theft, for example, of copper, one or more air conditioning components, and/or an air conditioning unit. The present invention is further directed to methods of making, as well as methods of using tamper-proof alarm components to detect theft, for example, of copper, one or more air conditioning components, and/or an air conditioning unit. The present invention is even further directed to kits and air conditioning systems comprising at least one of the herein-described tamper-proof alarm components for detecting theft of copper, one or more air conditioning components, and/or an air conditioning unit.

Figure 1A:
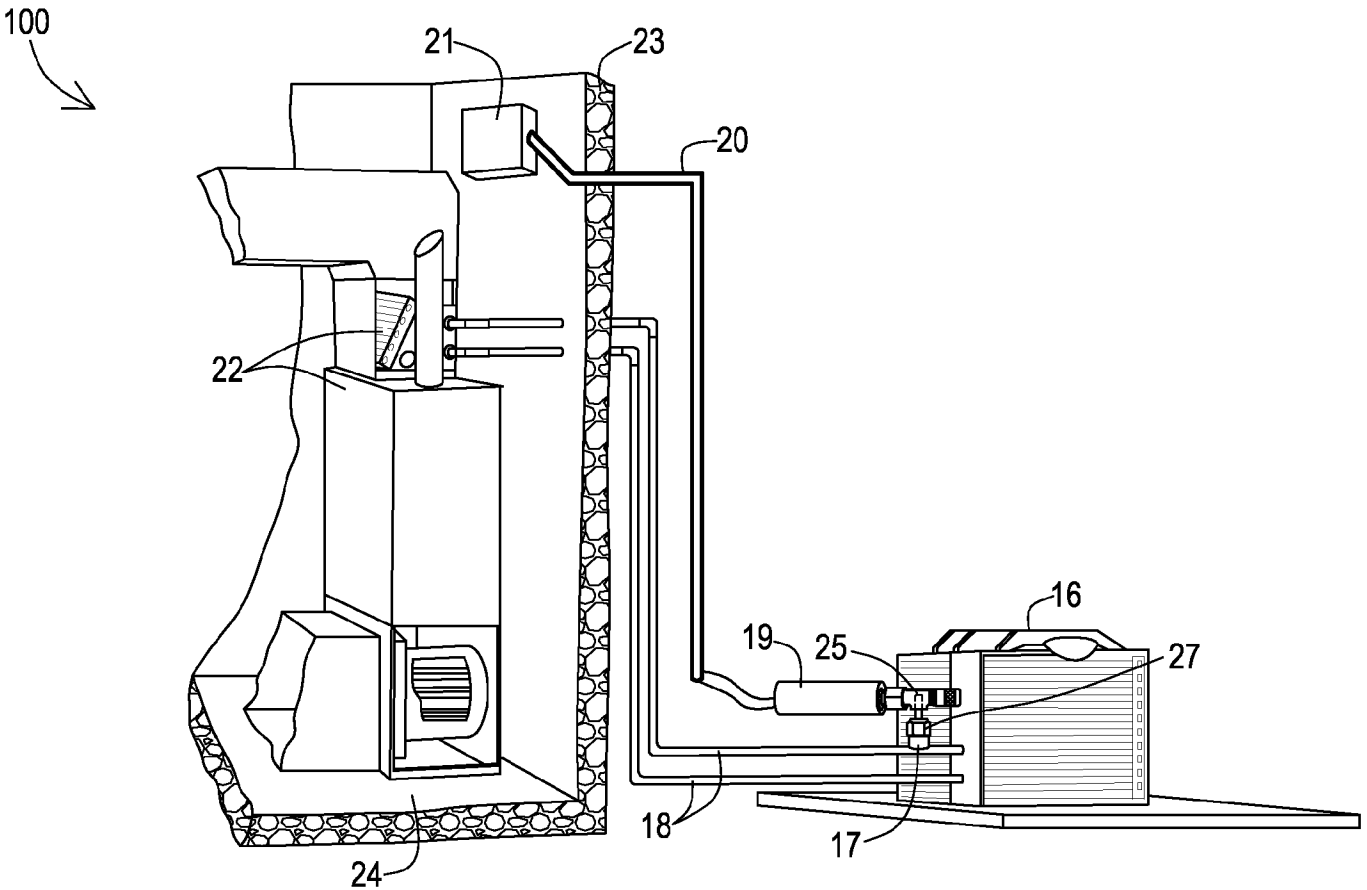
FIG. 1A depicts a view of an exemplary tamper-proof alarm component of the present invention in a typical air conditioning system.

One exemplary air conditioning system comprising a tamper-proof alarm component of the present invention is shown in FIG. 1A. As shown in FIG. 1A, exemplary air conditioning system 100 comprises an air conditioning unit 16, a security system 21, and an exemplary tamper-proof alarm component 19 positioned between air conditioning unit 16 (also referred to herein as "a HVAC system") and security system 21. Exemplary air conditioning system 100 further comprises (i) an optional swivel tee 25 positioned between air conditioning unit 16 (i.e., copper tubing 18 extending into air conditioning unit 16) and exemplary tamper-proof alarm component 19, (ii) service valve 17 (shown connected to optional swivel tee 25), (iii) copper tubing 18 of HVAC system 16, copper tubing 18 containing pressurized refrigerant (not shown), (iv) cable 20 extending between and connecting security system 21 to air conditioning unit 16, and (v) interior air handler 22 connected to copper tubing 18, interior air handler 22 being positioned on interior floor 24 within building wall 23.

Figure 1B:
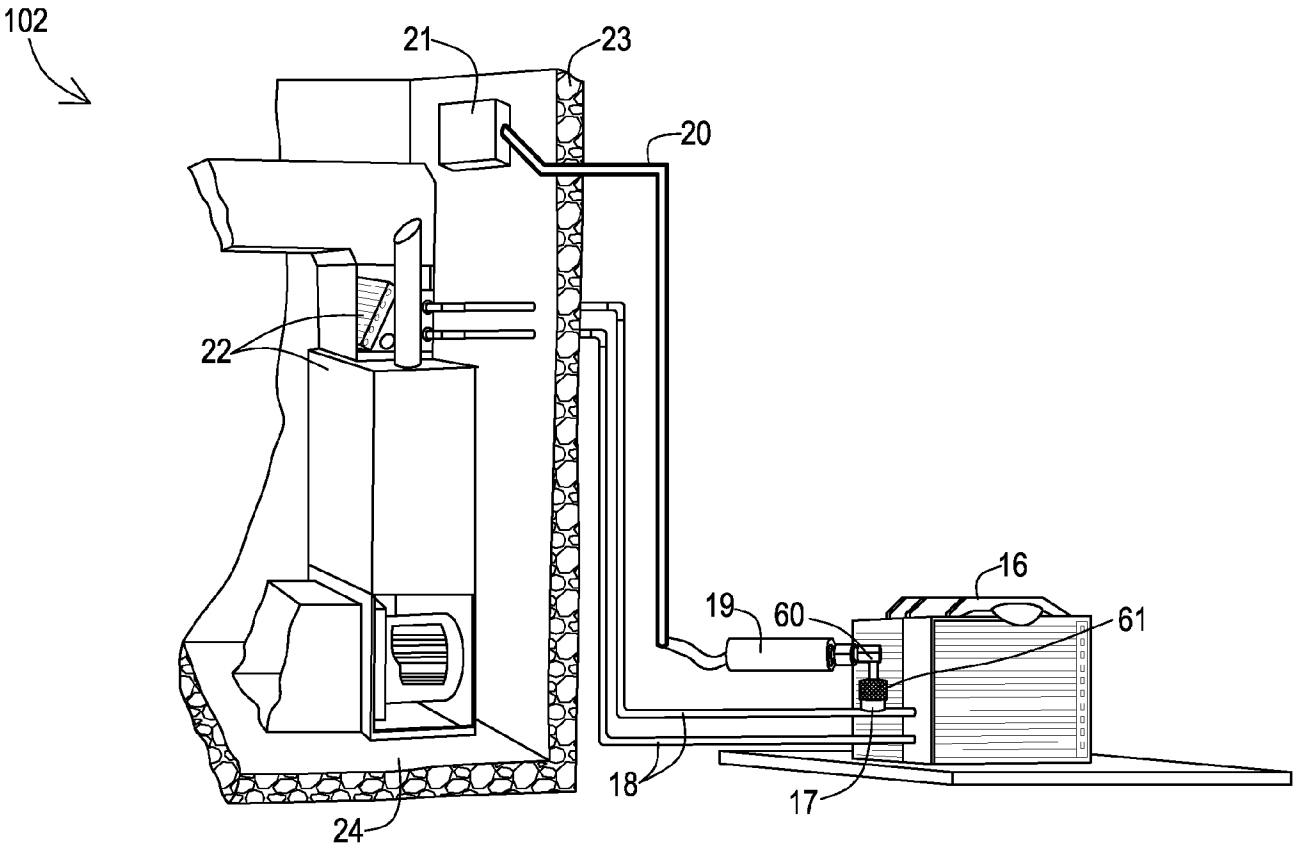
FIG. 1B depicts a view of an exemplary tamper-proof alarm component of the present invention in another typical air conditioning system.

Another exemplary air conditioning system comprising a tamper-proof alarm component of the present invention is shown in FIG. 1B. As shown in FIG. 1B, exemplary air conditioning system 102 comprises an air conditioning unit 16, a security system 21, and an exemplary tamper-proof alarm component 19 positioned between air conditioning unit 16 (also referred to herein as "a HVAC system") and security system 21. Exemplary air conditioning system 102 further comprises (i) a 90 degree charging head 60 positioned between air conditioning unit 16 (i.e., copper tubing 18 extending into air conditioning unit 16) and exemplary tamper-proof alarm component 19, (ii) service valve 17 (shown connected to 90 degree charging head 60), (iii) copper tubing 18 of HVAC system 16, copper tubing 18 containing pressurized refrigerant (not shown), (iv) cable 20 extending between and connecting security system 21 to air conditioning unit 16, and (v) interior air handler 22 connected to copper tubing 18, interior air handler 22 being positioned on interior floor 24 within building wall 23.

The tamper-proof alarm components of the present invention, such as exemplary tamper-proof alarm component 19, may comprise a number of components. A description of individual components and combinations of individual components is provided below.

I. Device Components

The tamper-proof alarm components of the present invention may comprise one or more of the following components.

A. Protective Sleeve Component

The tamper-proof alarm components of the present invention comprise a protective sleeve such as exemplary protective sleeve 11 shown in FIGS. 2A-3 and 5. As shown in FIGS. 2A-3 and 5, exemplary protective sleeve 11 has a first sleeve end 13 and a second sleeve end 14, second sleeve end 14 being positioned opposite first sleeve end 13. Exemplary protective sleeve 11 is also sized so as to encompass one or more electronic components of exemplary tamper-proof alarm component 19.

Typically, exemplary protective sleeve 11 has a length ranging from about 1.5 inches (in.) to about 3.0 in., and an outer diameter ranging from about 0.5 in. to about 1.0 in. However, it should be understood that exemplary protective sleeve 11 may have any desired dimensions that enable one or more electronic components of exemplary tamper-proof alarm component 19 to be contained within exemplary protective sleeve 11.

Exemplary protective sleeve 11 may comprise any thermoformable material. Suitable thermoformable materials include, but are not limited to, polymeric materials such as polyvinyl chloride, polyester, and polyolefins; metals such as stainless steel, aluminum, and steel; ceramics; and fiber-reinforced polymeric, metal or ceramic materials (e.g., a carbon fiber reinforced epoxy resin protective sleeve).

In one exemplary embodiment, exemplary protective sleeve 11 comprises a ¾"×2½" polyvinyl chloride protective sleeve.

B. Pressure Switch Component

Figure 2A:
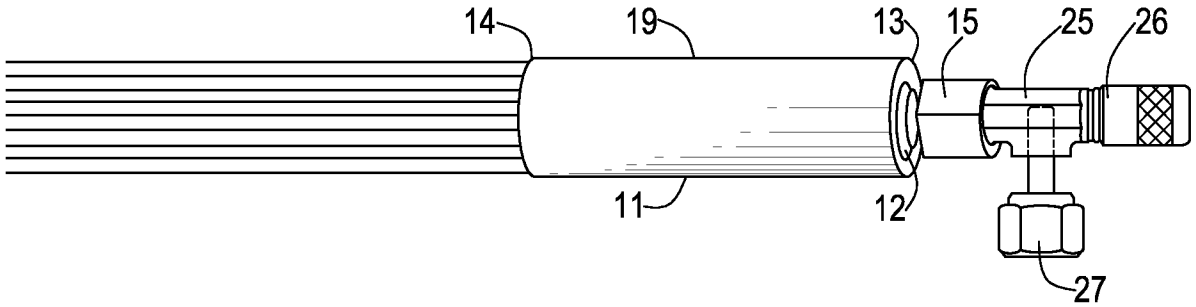
FIG. 2A depicts a view of the combination of (i) the exemplary tamper-proof alarm component and (ii) an exemplary swivel tee of the exemplary air conditioning system shown in FIG. 1A.
Figure 2B:
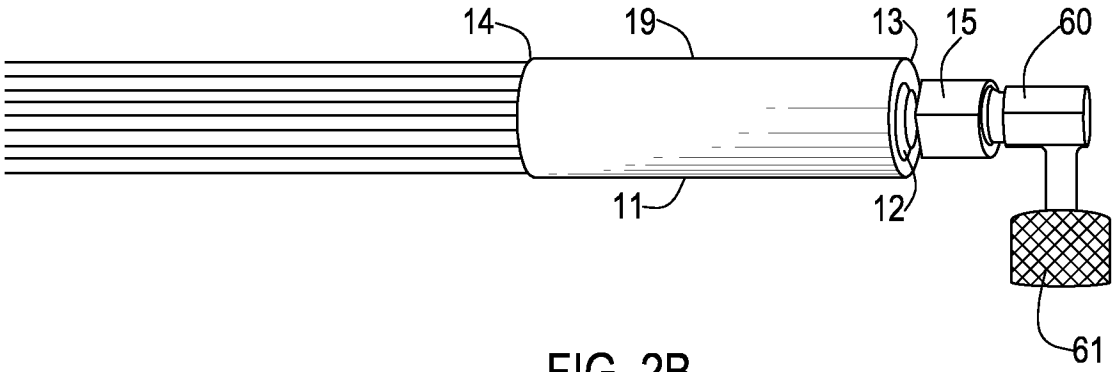
FIG. 2B depicts a view of the combination of (i) the exemplary tamper-proof alarm component and (ii) an exemplary 90 degree charging head of the exemplary air conditioning system shown in FIG. 1B.
Figure 3:
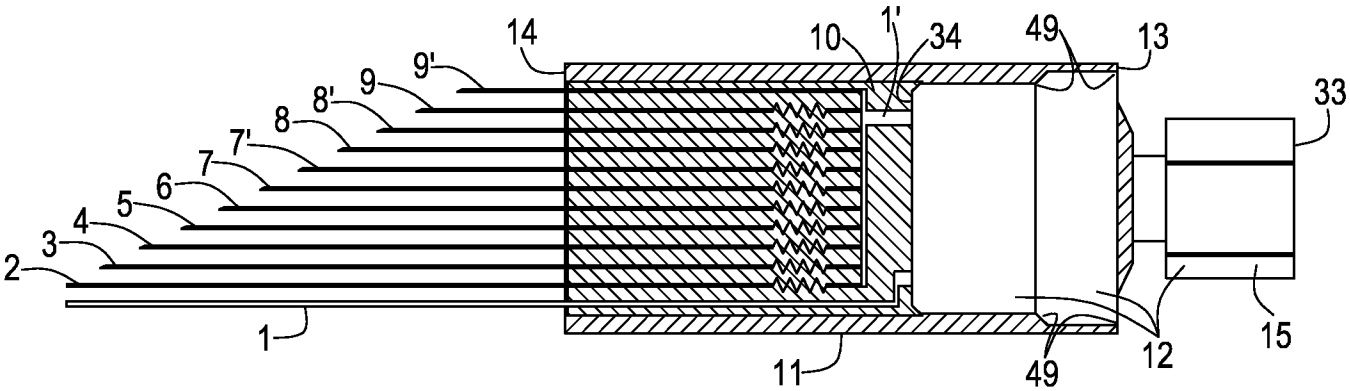
FIG. 3 depicts a cross-sectional view of the exemplary tamper-proof alarm component shown in FIG. 2.

The tamper-proof alarm components of the present invention further comprise a pressure switch such as exemplary pressure switch 12 shown in FIGS. 2A-4B. FIG. 3 provides a cross-sectional view of exemplary tamper-proof alarm component 19 shown in FIGS. 1A-2 so as to view exemplary pressure switch 12.

As shown in FIG. 3, exemplary pressure switch 12 is positioned within exemplary protective sleeve 11 so as to extend through exemplary protective sleeve 11. Exemplary pressure switch 12 comprises a first pressure switch end 33 and a second pressure switch end 34, second pressure switch end 34 being positioned opposite first pressure switch end 33. Exemplary pressure switch 12 further comprises (i) one or more electrically conductive switch inlet wires 1 extending into second pressure switch end 34 of exemplary pressure switch 12 and (ii) one or more electrically conductive switch outlet wires 2-9' extending from second pressure switch end 34 of exemplary pressure switch 12. As shown in FIG. 3, exemplary pressure switch 12 comprises a single electrically conductive switch outlet wire 1' extending from second pressure switch end 34 of exemplary pressure switch 12, which splits into one or more electrically conductive switch outlet wires 2-9' extending from second pressure switch end 34 of exemplary pressure switch 12 and out of exemplary protective sleeve 11.

As shown in FIG. 3 and discussed further below, one or more of one or more electrically conductive switch outlet wires 2-9' comprises a sleeve resistor (i.e., sleeve resistors R2-R9 shown in FIG. 5) positioned along one or more of the one or more electrically conductive switch outlet wires.

As shown in FIGS. 2A-3, exemplary pressure switch 12 further comprises a switch connector 15 at first pressure switch end 33 of exemplary pressure switch 12. Switch connector 15 enables exemplary pressure switch 12 to be attached to a corresponding connector of optional swivel tee 25 as shown in FIGS. 1A and 2A. For example, in one exemplary embodiment, switch connector 15 may comprise a ¼" flare female connector while the corresponding connector of optional swivel tee 25 comprises a ¼" male connector.

Although not shown in FIGS. 1A-3, it should be noted that switch connector 15 may be used to directly connect exemplary pressure switch 12 to service valve 17 of HVAC system 16 shown in FIG. 1A (in particular, directly connecting exemplary pressure switch 12 to service valve 17 on copper tubing 18 of HVAC system 16 shown in FIG. 1A without optional swivel tee 25). In addition, in an alternative embodiment shown in FIGS. 1B and 2B, switch connector 15 of exemplary pressure switch 12 may be connected to service valve 17 of HVAC system 16 via 90 degree charging head 60.

It should be noted that any connecting component may be used, if desired, to connect switch connector 15 of exemplary pressure switch 12 to service valve 17 of HVAC system 16. In other embodiments (not shown), a straight charging head or a 45 degree charging head may be used in place of 90 degree charging head 60. In each case, the charging head comprises (i) a corresponding female or male connector for connecting to switch connector 15 of exemplary pressure switch 12, and (ii) a second charging head connector operatively adapted to connect to service valve 17 of HVAC system 16.

Figure 5:
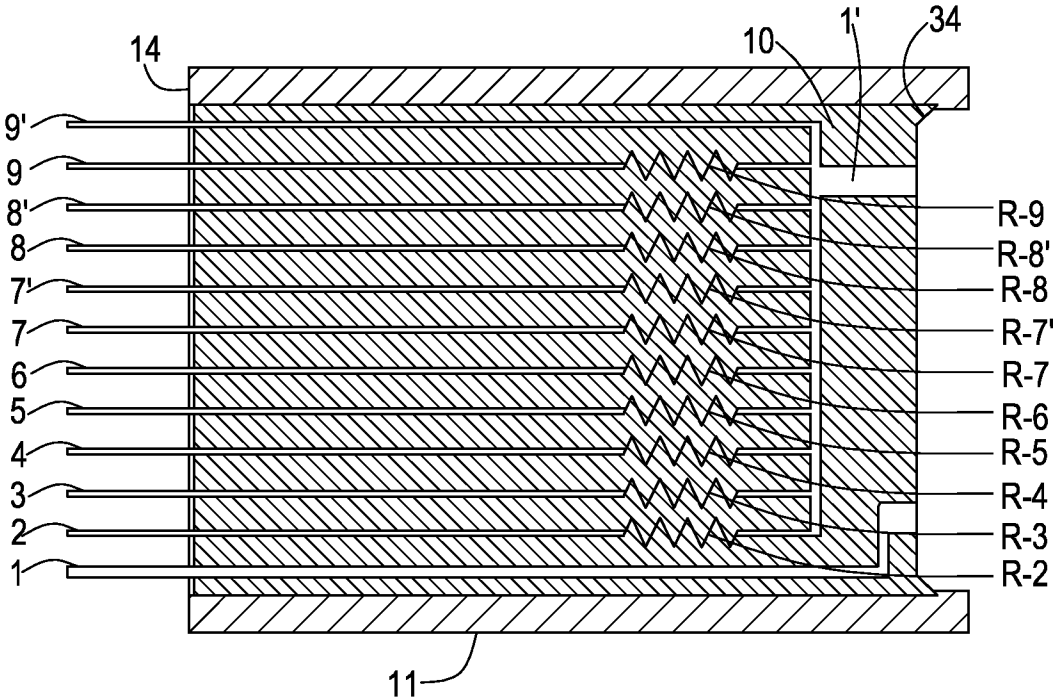
FIG. 5 depicts an exploded view of the exemplary circuitry of the exemplary tamper-proof alarm component shown in FIGS. 1A-3.

Further, shown in FIGS. 3 and 5, it should be noted that the alarm component of the present invention may further comprise an electrically conductive auxiliary switch outlet wire 9' extending from the pressure switch (i.e., exemplary pressure switch 12) and out of the second end of the protective sleeve (i.e., second sleeve end 14 of exemplary protective sleeve 11), wherein the auxiliary switch outlet wire comprises an outlet wire without a sleeve resistor positioned along the outlet wire and within the protective sleeve. Such an auxiliary switch outlet wire could be used to connect to a system requiring a special amount of resistance that is not reflected in any of the sleeve resistors discussed herein.

When present, auxiliary switch outlet wire 9' may be electrically connected to outlet wire 1' along with the one or more electrically conductive outlet wires comprising a sleeve resistor (e.g., one or more electrically conductive outlet wires 2-9) as shown in FIG. 5. However, it should be understood that in most cases, an auxiliary switch outlet wire 9' is unnecessary given that a specialty alarm component of the present invention may be prepared using any desired sleeve resistor or combination of sleeve resistors.

Figure 4A:
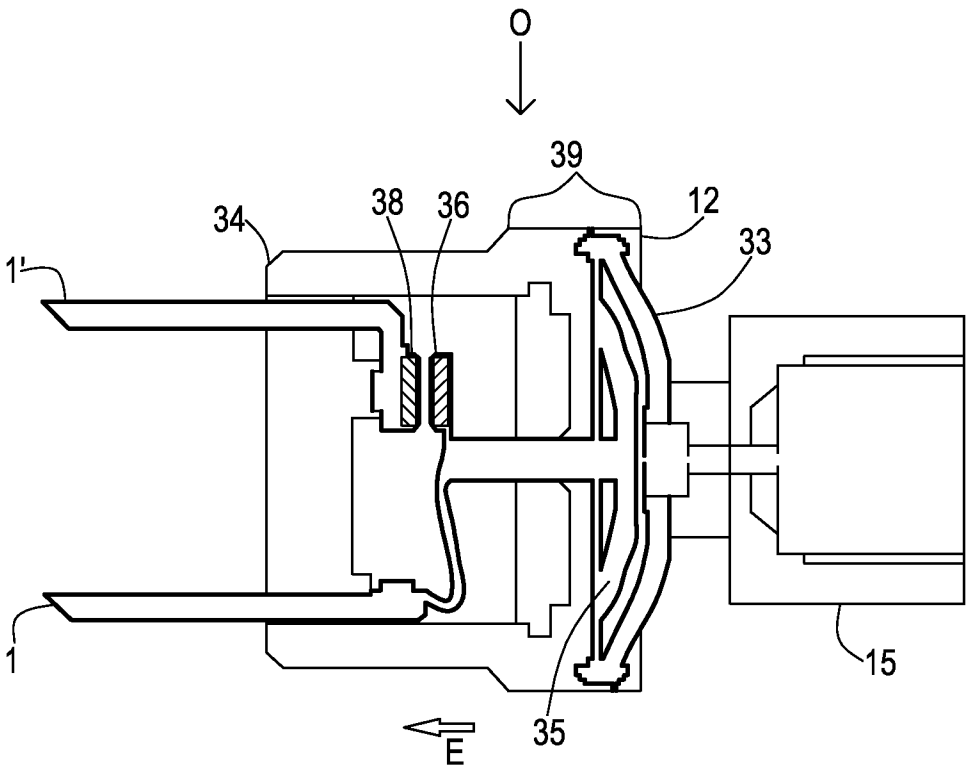
FIGS. 4A-4B depict cross-sectional views of an exemplary pressure switch of the exemplary tamper-proof alarm component shown in FIGS. 1A-3 with the exemplary pressure switch in an "open" position (FIG. 4A) and in a "closed" position (FIG. 4B)
Figure 4B:
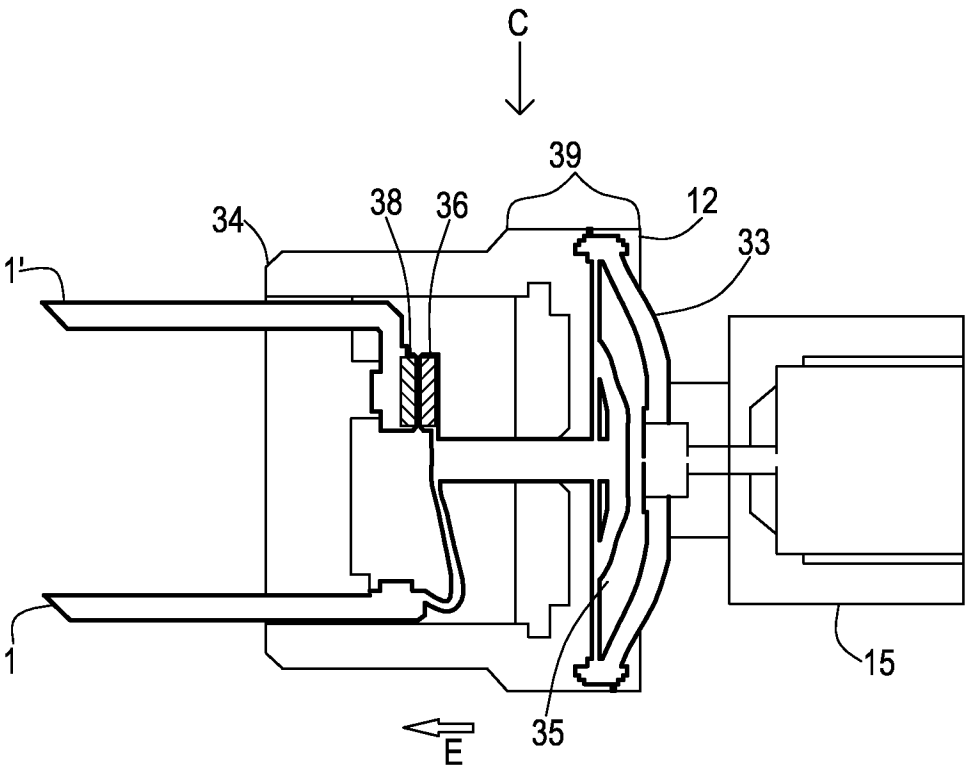

Exemplary pressure switch 12 may even further comprise a switch trigger proximate first pressure switch end 33 as shown in FIGS. 4A-4B. As shown in FIGS. 4A-4B, exemplary switch trigger 35 is movable between an open switch circuit position (shown in FIG. 4A wherein exemplary switch trigger 35 is in position "O") and a closed switch circuit position (shown in FIG. 4B wherein exemplary switch trigger 35 is in position "C") in response to a threshold amount of pressure being exerted on exemplary switch trigger 35. When exemplary switch trigger 35 is in an open switch circuit position as shown in FIG. 4A, exemplary switch trigger contact 36 is not in contact with corresponding contact 38 proximate ends of (i) exemplary electrically conductive switch inlet wire 1 extending into second pressure switch end 34 of exemplary pressure switch 12 and (ii) exemplary electrically conductive switch outlet wire 1' extending out of second pressure switch end 34 of exemplary pressure switch 12. Consequently, an electrical current cannot pass through the circuitry within exemplary pressure switch 12 in the open configuration shown in FIG. 4A.

When a threshold amount of pressure is exerted onto exemplary switch trigger 35 (e.g., a pressure in the amount of greater than or equal to about 5.0 psi, or greater than or equal to about 20 psi), exemplary switch trigger 35 moves in direction E into a closed switch circuit position as shown in FIG. 4B. In the closed configuration, exemplary switch trigger contact 36 is in contact with corresponding contact 38 proximate ends of (i) exemplary electrically conductive switch inlet wire 1 extending into second pressure switch end 34 of exemplary pressure switch 12 and (ii) exemplary electrically conductive switch outlet wire 1' extending out of second pressure switch end 34 of exemplary pressure switch 12. Consequently, an electrical current can pass through the circuitry within exemplary pressure switch 12 in the closed configuration shown in FIG. 4B.

Typically, exemplary pressure switch 12 has outer dimensions so as to enable exemplary pressure switch 12 to fit within a protective sleeve, such as exemplary protective sleeve 11, having sleeve dimensions as discussed above. However, it should be understood that exemplary pressure switch 12 may have any desired dimensions so as to enable exemplary pressure switch 12 to fit within a given protective sleeve.

In one desired embodiment, such as shown in FIG. 3, a portion of inner surface 49 along first sleeve end 13 of exemplary protective sleeve 11 is removed (i.e., hollowed out) so that an outermost section 39 (shown in FIGS. 4A and 4B) of exemplary pressure switch 12 fits snugly within first sleeve end 13 of exemplary protective sleeve 11. As shown in FIG. 3, exemplary protective sleeve 11 has a sleeve wall thickness at second sleeve end 14 that is greater than a sleeve wall thickness at first sleeve end 13.

C. Sleeve Resistor Components

As discussed briefly above, the tamper-proof alarm components of the present invention may further comprise one or more sleeve resistors such as exemplary sleeve resistors R2-R9 shown in FIG. 5. Desirably, when two or more sleeve resistors (e.g., only exemplary sleeve resistors R2-R3) are present, the two or more sleeve resistors are in parallel relationship with one another as shown in FIG. 5.

In one exemplary embodiment, the alarm component of the present invention comprises two or more electrically conductive switch outlet wires, each of which comprises a single sleeve resistor positioned along a given switch outlet wire, wherein each sleeve resistor comprises a different resistance (e.g., a 1000 ohms resistor, a 2000 ohms resistor, etc.). In a further exemplary embodiment, the alarm component of the present invention comprises five electrically conductive switch outlet wires, each of which comprises a single sleeve resistor, wherein each of the five sleeve resistors comprises a different resistance (e.g., a 1000 ohms resistor, a 2000 ohms resistor, a 2200 ohms resistor, a 3300 ohms resistor, a 4700 ohms resistor, etc.). In yet a further exemplary embodiment, the alarm component of the present invention comprises eight electrically conductive switch outlet wires, each of which comprises a single sleeve resistor (i.e., sleeve resistors R2-R8), wherein each of the eight sleeve resistors comprises a different resistance (e.g., a 1000 ohms resistor, a 2000 ohms resistor, a 2200 ohms resistor, a 3300 ohms resistor, a 4700 ohms resistor, a 5600 ohms resistor, a 33,000 ohms resistor, and a 47,000 ohms resistor). In yet a further exemplary embodiment, the alarm component of the present invention comprises eleven electrically conductive switch outlet wires (such as outlet wires 2-9' shown in FIG. 5), wherein (i) ten of the electrically conductive switch outlet wires each independently comprise a single sleeve resistor (i.e., sleeve resistors R2-R9) inside exemplary protective sleeve 11, wherein each of the ten sleeve resistors comprises, for example, a different resistance (e.g., a 1000 ohms resistor, a 2000 ohms resistor, a 2200 ohms resistor, a 3300 ohms resistor, a 4700 ohms resistor, a 5600 ohms resistor, a 10,000 ohms resistor, a 33,000 ohms resistor, a 47,000 ohms resistor, and a 470,000 ohms resistor), and (ii) one of the eleven electrically conductive switch outlet wires (i.e., electrically conductive switch outlet wire 9') does not comprise a sleeve resistor inside exemplary protective sleeve 11.

In one desired embodiment, the alarm component of the present invention comprises two or more sleeve resistors, wherein the two or more sleeve resistors have an ohm range of from about 1000 ohms to about 470,000 ohms. However, it should be understood that any number of electrically conductive outlet wires and corresponding sleeve resistors may be used in the present invention, and the range of the sleeve resistors may also vary as desired, such as discussed herein.

D. Hardening Components

The tamper-proof alarm components of the present invention further comprise a hardened matrix material such as exemplary hardened matrix material 10 shown in FIGS. 3 and 5. Exemplary hardened matrix material 10 may comprise any non-conductive matrix material that hardens to encapsulate the above-described components positioned within exemplary protective sleeve 11. Suitable hardenable matrix materials include, but are not limited to, thermosettable materials such as epoxies, and high performance thermoplastic materials such as polyaryletherketones and some polyesters.

In one desired embodiment, the hardenable matrix material (and hardened matrix material) comprises an epoxy resin.

As discussed above, exemplary hardened matrix material 10 desirably fills at least a portion (in some embodiments, substantially all or all) of an inner sleeve volume positioned within the protective sleeve and extending a length along the protective sleeve. Exemplary hardened matrix material 10 may extend from proximate second sleeve end 14 to pressure switch 12 (i.e., second pressure switch end 34) or any length therebetween. Desirably, exemplary hardened matrix material 10 encapsulates (i) at least a portion of each of the one or more electrically conductive switch inlet wires 1 positioned within protective sleeve 11, and (ii) at least a portion of each of the one or more electrically conductive switch outlet wires 2-9' positioned within protective sleeve 11, as well as any sleeve resistor (e.g., R2-R9) present along the one or more electrically conductive switch outlet wires 2-9' positioned within protective sleeve 11.

II. Methods of Making Tamper-Proof Alarm Components

The present invention is also directed to methods of making tamper-proof alarm components. In one exemplary embodiment of the present invention, the method of making a tamper-proof alarm component comprises the steps of positioning a pressure switch within a protective sleeve so that (1) a switch trigger of the pressure switch is proximate a first sleeve end and (2) (i) one or more electrically conductive switch inlet wires, and (iii) one or more electrically conductive switch outlet wires extend from the pressure switch and out of a second sleeve end of the protective sleeve; filling at least a portion of the protective sleeve between second pressure switch end 34 and second sleeve end 14 (preferably, all of the protective sleeve between second pressure switch end 34 and second sleeve end 14) with a hardenable matrix material; and allowing the hardenable matrix material to harden.

In another exemplary embodiment of the present invention, the method of making a tamper-proof alarm component comprises the steps of electrically connecting one or more sleeve resistor components in parallel with one another and electrically connecting the parallel connected sleeve resistor components to an outlet wire of the pressure switch; positioning the resulting pressure switch within a protective sleeve so that (1) a switch trigger of the pressure switch is proximate a first sleeve end and (2) (i) one or more electrically conductive switch inlet wires, and (ii) one or more electrically conductive switch outlet wires with the parallel connected sleeve resistor components extend from the pressure switch and out of a second sleeve end of the protective sleeve; filling at least a portion of the protective sleeve between second pressure switch end 34 and second sleeve end 14 (preferably, all of the protective sleeve between second pressure switch end 34 and second sleeve end 14) with a hardenable matrix material; and allowing the hardenable matrix material to harden.

Any of the herein-described methods of making a tamper-proof alarm component of the present invention may further comprise one or more additional steps including, but not limited to, forming a protective sleeve component; hollowing out an inner surface portion of a given protective sleeve (e.g., inner sleeve portion 49 shown in FIG. 3) to fit a pressure switch snugly therein; combining a customer specific combination of sleeve resistors within a given alarm component; injecting hardenable matrix material into the second sleeve end of the protective sleeve; exposing the injecting hardenable matrix material to a temperature so as to cure the injecting hardenable matrix material; incorporating an auxiliary outlet wire into the alarm component; and packaging the alarm component.

Other methods of the present invention may include forming a kit containing one or more of the herein-described alarm components of the present invention. Suitable kits may include, but are not limited to, any of the herein-described alarm components, one or more tees, one or more 90 degree charging heads, one or more rubber o-rings for use with the one or more tees and/or 90 degree charging heads, one or more external resistors, one or more additional protective sleeves, one or more containers of hardenable matrix material, one or more pieces of electrically conductive wire, one or more technician tools, or any combination thereof.

III. Methods of Using Tamper-Proof Alarm Components

The present invention is even further directed to methods of using the above-described tamper-proof alarm components. In one exemplary embodiment of the present invention, the method comprises a method of electronically detecting the tampering with, attempted theft of, or theft of the exterior unit of an air conditioning system or HVAC system, more particularly the copper tubing or coils thereof, by connecting the tamper-proof alarm component to a host electronic security system.

The method of detecting theft of (i) a copper coil within an air conditioning unit, (ii) any other component or components within the air conditioning unit, or (iii) the air conditioning unit may comprise, for example, simply electrically connecting any of the herein-described alarm components to the air conditioning unit, such as shown in FIG. 1A or FIG. 1B.

The pressure switch of the herein-described alarm components attaches to the service valve of a HVAC coil (i.e., air conditioning unit 16) and typically completes the circuit of a host Electronic Security System (ESS) (i.e., security system 21) when there is sufficient pressure (e.g., greater than about 5.0 psi, or greater than about 10.0 psi, or greater than about 15.0 psi, or greater than about 20.0 psi, or greater than about 25.0 psi) inside the HVAC coil (i.e., a normal condition). Any condition that causes the pressure inside the HVAC coil to drop below a sufficient level (i.e., so that exemplary pressure switch 12 moves to an open configuration as shown in FIG. 4A) or removing the pressure switch will open or break the circuit causing an alarm condition on the host ESS (i.e., security system 21).

As shown in FIGS. 1A and 1B, and as discussed above, the pressure switch (i.e., exemplary pressure switch 12) of the herein-described alarm component (i.e., exemplary alarm component 19) can attach to the service valve (i.e., service valve 17) of a HVAC coil (i.e., air conditioning unit 16) via an optional swivel tee (i.e., exemplary swivel tee 25) or via a 90 degree charging head (i.e., exemplary 90 degree charging head 60).

FIG. 2A depicts a view of an exemplary combination of the present invention, wherein the exemplary combination comprising (i) exemplary tamper-proof alarm component 19 and (ii) an exemplary swivel tee 25 used in exemplary air conditioning system 100 shown in FIG. 1A. As shown in FIG. 2A, switch connector 15 of exemplary pressure switch 12 is connected to one end of exemplary swivel tee 25. Exemplary swivel tee 25 further comprises (1) a connector 26, which connects exemplary swivel tee 25 to a HVAC technician's testing and/or charging equipment, and (2) a service valve connector 27 sized to connect to service valve 17 of HVAC system 16.

FIG. 2B depicts a view of an exemplary combination of the present invention, wherein the exemplary combination comprising (i) exemplary tamper-proof alarm component 19 and (ii) exemplary 90 degree charging head 60 used in exemplary air conditioning system 102 shown in FIG. 1B. As shown in FIG. 2B, switch connector 15 of exemplary pressure switch 12 is connected to one end of exemplary 90 degree charging head 60. Exemplary 90 degree charging head 60 further comprises a service valve connector 61 sized to connect to service valve 17 of HVAC system 16.

In some embodiments, it may be advantageous to position an o-ring between (i) switch connector 15 of exemplary pressure switch 12 and (ii) any connecting component, when used (e.g., exemplary swivel tee 25 or exemplary 90 degree charging head 60). An exemplary o-ring 70 is shown in FIGS. 6A-6B.

Figure 6B:
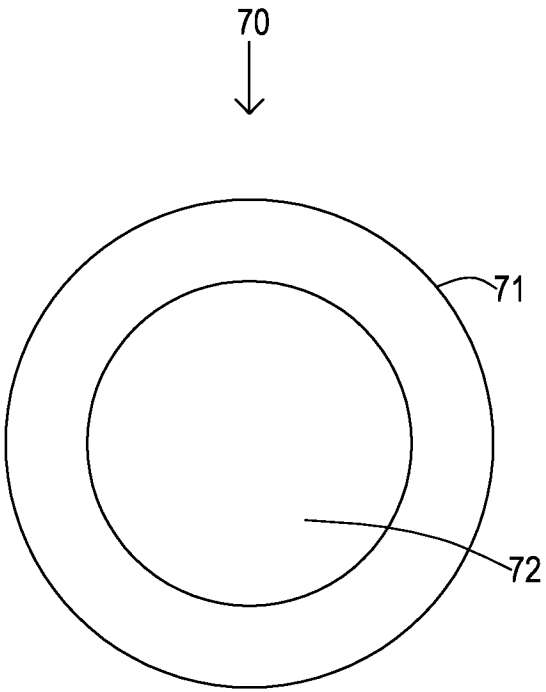
FIGS. 6A-6B depict frontal and side views of an exemplary o-ring that can be used with the exemplary tamper-proof alarm component shown in FIGS. 1A-5.
Figure 6A:
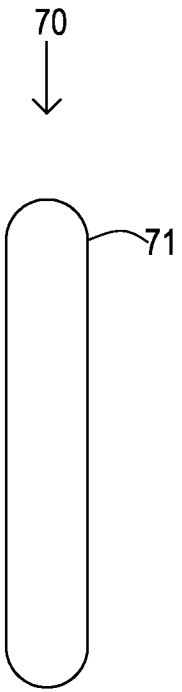

As shown in FIGS. 6A-6B, exemplary o-ring 70 has an outer perimeter 71 and an aperture 72 extending through exemplary o-ring 70 and positioned a distance from outer perimeter 71.

The end-of-line resistors, used in the present invention, are compatible with essentially all brands of ESS (i.e., security system 21) and are field-selectable by an installing technician. The end-of-line resistors allow the host ESS to protect the pressure switch (i.e., exemplary pressure switch 12) and the cable from tampering and/or circumvention by a would-be thief by causing an alarm condition on the host ESS (i.e., security system 21) upon short circuiting or sectioning the cable or the pressure switch, or causing or inducing any impedance beyond the threshold of the host ESS.

It should be noted that the tamper-proof alarm components of the present invention may be used in combination with a host ESS (i.e., security system 21) that provides one or more alarm signals when a change in the normal condition of the closed electrical loop comprising (i) the tamper-proof alarm component of the present invention and (ii) the host ESS (i.e., security system 21) is detected. Suitable alarm signals may include, but are not limited to, a siren at the site of the air conditioning unit, a silent alarm signal sent to a monitoring station of the host ESS (i.e., security system 21), a silent alarm signal sent directly to any other entity (e.g., a private security guard, etc.), or any combination thereof.

The present invention is described above and further illustrated below by way of examples, which are not to be construed in any way as imposing limitations upon the scope of the invention. On the contrary, it is to be clearly understood that resort may be had to various other embodiments, modifications, and equivalents thereof which, after reading the description herein, may suggest themselves to those skilled in the art without departing from the spirit of the present invention and/or the scope of the appended claims.

Example 1

Preparation of a Tamper-Proof Alarm Component

Exemplary tamper-proof alarm components as shown in FIGS. 1A, 2A and 3-5 were prepared and connected to air conditioning systems as shown in FIG. 1A.

Example 2

Preparation of a Tamper-Proof Alarm Component

Exemplary tamper-proof alarm components as shown in FIGS. 1B, 2B and 3-5 were prepared and connected to air conditioning systems as shown in FIG. 1B.

While the specification has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A tamper-proof alarm component for detecting theft, said alarm component comprising:

a protective sleeve having a first sleeve end and a second sleeve end, said second sleeve end being positioned opposite said first sleeve end;

a pressure switch positioned so as to extend through said protective sleeve, said pressure switch comprising (i) a switch trigger proximate said first sleeve end, (ii) one or more electrically conductive switch inlet wires, and (iii) one or more electrically conductive switch outlet wires, said switch trigger being movable between an open switch circuit position and a closed switch circuit position in response to a threshold amount of pressure being exerted on said switch trigger; and a hardened matrix material filling at least a portion of an inner sleeve volume positioned within said protective sleeve and extending a length along said protective sleeve from proximate said second sleeve end to said pressure switch, said hardened matrix material encapsulating (i) at least a portion of each of said one or more electrically conductive switch inlet wires positioned within said protective sleeve, and (ii) at least a portion of each of said one or more electrically conductive switch outlet wires positioned within said protective sleeve.

2. The alarm component of claim 1, wherein said alarm component further comprises a sleeve resistor positioned along one or more of said one or more electrically conductive switch outlet wires, wherein when two or more sleeve resistors are present, said two or more sleeve resistors are in parallel relationship with one another; and wherein said hardened matrix material encapsulates any sleeve resistor positioned along one or more of said one or more electrically conductive switch outlet wires.

3. The alarm component of claim 1, wherein said pressure switch is in said open switch circuit position when an amount of pressure exerted on said switch trigger is less than said threshold amount of pressure, and in said closed switch circuit position when the amount of pressure exerted on said switch trigger is greater than or equal to said threshold amount of pressure.

4. The alarm component of claim 1, wherein said pressure switch further comprises a male or female connector operatively adapted to connect said pressure switch to a corresponding female or male connector of a connecting component.

5. The alarm component of claim 4, wherein said connecting component comprises a swivel tee, said swivel tee comprising (i) said corresponding female or male connector, (ii) a second swivel tee connector operatively adapted to connect to a service valve of an air conditioning system; and (iii) a third swivel tee connector.

6. The alarm component of claim 4, wherein said connecting component comprises a charging head, said charging head comprising (i) said corresponding female or male connector, and (ii) a second charging head connector operatively adapted to connect to a service valve of an air conditioning system.

7. The alarm component of claim 4, wherein said connecting component further comprises an o-ring sized and operatively adapted to seal a connection between male or female connector of said pressure switch and said corresponding female or male connector of said connecting component.

8. The alarm component of claim 1, wherein said one or more electrically conductive switch inlet wires comprises a single inlet wire.

9. The alarm component of claim 1, wherein at least one of said one or more electrically conductive switch outlet wires comprises an electrically conductive auxiliary switch outlet wire extending from said pressure switch and out of said second end of said protective sleeve, said auxiliary switch outlet wire being without a sleeve resistor positioned within said protective sleeve.

10. The alarm component of claim 1, wherein said one or more electrically conductive switch outlet wires comprises two or more electrically conductive switch outlet wires, one or more of which comprises a single sleeve resistor positioned along a given switch outlet wire, wherein each sleeve resistor comprises a different resistance.

11. The alarm component of claim 1, wherein said one or more electrically conductive switch outlet wires comprises five electrically conductive switch outlet wires, each of which comprises a single sleeve resistor, wherein each of the five sleeve resistors comprises a different resistance.

12. The alarm component of claim 1, wherein said one or more electrically conductive switch outlet wires comprises (i) eleven electrically conductive switch outlet wires, (ii) ten of which each comprises a single sleeve resistor therealong, wherein each of the ten sleeve resistors comprises a different resistance, and (iii) one of which comprises of a single electrically conductive auxiliary switch outlet wire without a sleeve resistor.

13. The alarm component of claim 1, wherein said pressure switch comprises two or more sleeve resistors, and said two or more sleeve resistors have an ohm range of from about 1000 ohms to about 470,000 ohms.

14. The alarm component of claim 1, wherein said hardened matrix material extends from said pressure switch to said second sleeve end.

15. The alarm component of claim 1, wherein said hardened matrix material comprises an epoxy.

16. The alarm component of claim 1, wherein said protective sleeve comprises a polymer sleeve.

17. An air conditioning system comprising the alarm component of claim 1 in combination with an air conditioning unit.

18. A kit comprising the alarm component of claim 1 in combination with one or more additional kit components, said one or more additional kit components comprising one or more 90 degree charging heads, one or more resistors, one or more additional protective sleeves, hardenable matrix material, one or more pieces of electrically conductive wire, or any combination thereof.

19. A method of detecting theft of (i) an air conditioning unit, or (ii) any component within the air conditioning unit, said method comprising:

electrically connecting the alarm component of claim 1 to the air conditioning unit.

20. A method of making the alarm component of claim 1, said method comprising:

positioning the pressure switch within the protective sleeve so that (1 ) the switch trigger is proximate the first sleeve end and (2 ) (i) the one or more electrically conductive switch inlet wires, and (ii) the one or more electrically conductive switch outlet wires extend from the pressure switch and out of the second sleeve end;

filling at least a portion of the protective sleeve with a hardenable matrix material; and allowing the hardenable matrix material to harden so as to form the hardened matrix material.

21. A tamper-proof alarm component for detecting theft, said alarm component comprising:

a protective sleeve having a first sleeve end and a second sleeve end, said second sleeve end being positioned opposite said first sleeve end;

a pressure switch positioned so as to extend through said protective sleeve, said pressure switch comprising (i) a switch trigger proximate said first sleeve end, (ii) a single electrically conductive switch inlet wire, and (iii) one or more electrically conductive switch outlet wires, said switch trigger being movable between an open switch circuit position and a closed switch circuit position in response to a threshold amount of pressure being exerted on said switch trigger;

a sleeve resistor positioned along one or more of the one or more electrically conductive switch outlet wires, wherein when two or more sleeve resistors are present, the two or more sleeve resistors are in parallel relationship with one another; and a hardened matrix material filling at least a portion of an inner sleeve volume positioned within said protective sleeve and extending a length along said protective sleeve from proximate said second sleeve end to said pressure switch, said hardened matrix material encapsulating (i) a portion of said single electrically conductive switch inlet wire positioned within said protective sleeve, (ii) a portion of each of said one or more electrically conductive switch outlet wires positioned within said protective sleeve, and (iii) any sleeve resistors.

22. An air conditioning system comprising a tamper-proof alarm component for detecting theft of one or more components of said air conditioning system, said alarm component comprising:

a protective sleeve having a first sleeve end and a second sleeve end, said second sleeve end being positioned opposite said first sleeve end;

a pressure switch positioned so as to extend through said protective sleeve, said pressure switch comprising (i) a switch trigger proximate said first sleeve end, (ii) one or more electrically conductive switch inlet wires, and (iii) one or more electrically conductive switch outlet wires, said switch trigger being movable between an open switch circuit position and a closed switch circuit position in response to a threshold amount of pressure being exerted on said switch trigger;

a sleeve resistor positioned along one or more of said one or more electrically conductive switch outlet wires, wherein when two or more sleeve resistors are present, said two or more sleeve resistors are in parallel relationship with one another; and a hardened matrix material filling at least a portion of an inner sleeve volume positioned within said protective sleeve and extending a length along said protective sleeve from proximate said second sleeve end to said pressure switch, said hardened matrix material encapsulating (i) at least a portion of each of said one or more electrically conductive switch inlet wires positioned within said protective sleeve, (ii) at least a portion of each of said one or more electrically conductive switch outlet wires positioned within said protective sleeve, and (iii) any sleeve resistor positioned along said one or more electrically conductive switch outlet wires and within said protective sleeve.

* * * * *